US011313597B2

(12) United States Patent
Shen et al.

(10) Patent No.: US 11,313,597 B2
(45) Date of Patent: Apr. 26, 2022

(54) HEAT PUMP AND CONTROL METHOD THEREOF

(71) Applicant: Carrier Corporation, Palm Beach Gardens, FL (US)

(72) Inventors: Guangyu Shen, Shanghai (CN); Jingkai Weng, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 145 days.

(21) Appl. No.: 16/612,893

(22) PCT Filed: May 1, 2018

(86) PCT No.: PCT/US2018/030425
§ 371 (c)(1),
(2) Date: Nov. 12, 2019

(87) PCT Pub. No.: WO2018/208539
PCT Pub. Date: Nov. 15, 2018

(65) Prior Publication Data

US 2020/0158390 A1 May 21, 2020

(30) Foreign Application Priority Data

May 12, 2017 (CN) ..... 201710332939.1

(51) Int. Cl.
*F25B 41/20* (2021.01)
*F25B 30/02* (2006.01)
(Continued)

(52) U.S. Cl.
CPC ..... *F25B 41/20* (2021.01); *F25B 30/02* (2013.01); *F25B 41/31* (2021.01); *F25B 49/02* (2013.01)

(58) Field of Classification Search
CPC .... F25B 30/02; F25B 49/02; F25B 2313/003; F25B 2313/009; F25B 2313/021
See application file for complete search history.

(56) References Cited

U.S. PATENT DOCUMENTS 4,299,098 A 11/1981 Derosier
8,539,789 B2 9/2013 Kopko et al.
(Continued)

FOREIGN PATENT DOCUMENTS

CN 2418408 Y 2/2001
CN 2498531 Y 7/2002
(Continued)

OTHER PUBLICATIONS

International Search Report and Written Opinion for applicaiton PCT/US2018/020425, dated Jul. 16, 2018, 15 pages.
(Continued)

*Primary Examiner* — Henry T Crenshaw
(74) *Attorney, Agent, or Firm* — Cantor Colburn LLP

(57) ABSTRACT

The present invention provides a heat pump system which comprises a compressor (110), a mode switch valve assembly (120), a mode switch flow path, and a first heat exchanger, a second heat exchanger and a heat recovery heat exchanger respectively connected between the mode switch valve assembly and the mode switch flow path, wherein the mode switch flow path is provided with a first flow path (160), a second flow path (170) and a third flow path (180) which converge at an intersection point, and at least the first flow path and the second flow path are respectively provided with a throttling section (161,171), and the first flow path, the second flow path and the third flow path are controllably switched on/off to realize different function modes. There-
(Continued)

fore, a heat pump unit having a heat recovery function is provided, which has advantages of simple structure and high operational reliability, etc.

9 Claims, 7 Drawing Sheets

(51) Int. Cl.
*F25B 49/02* (2006.01)
*F25B 41/31* (2021.01)

(56) References Cited

U.S. PATENT DOCUMENTS

| | | | | |
|---|---|---|---|---|
| 8,839,635 | B2 | 9/2014 | Radhakrishnan et al. | |
| 2013/0167559 | A1* | 7/2013 | Kim | F24D 19/1087 62/56 |
| 2015/0267951 | A1* | 9/2015 | Berg | F25B 49/02 62/77 |
| 2015/0345846 | A1 | 12/2015 | Kopko et al. | |
| 2016/0195311 | A1* | 7/2016 | Li | F24H 4/04 62/115 |
| 2017/0370623 | A1* | 12/2017 | Wang | F24H 4/02 |

FOREIGN PATENT DOCUMENTS

| | | | |
|---|---|---|---|
| CN | 101514855 | A | 8/2009 |
| CN | 201607066 | U | 10/2010 |
| CN | 201615654 | U | 10/2010 |
| CN | 202119162 | U | 1/2012 |
| CN | 102364270 | A | 2/2012 |
| CN | 102914083 | A | 2/2013 |
| CN | 202770054 | U | 3/2013 |
| CN | 202770082 | U | 3/2013 |
| CN | 202869069 | U | 4/2013 |
| CN | 203068742 | U | 7/2013 |
| CN | 103851760 | A | 6/2014 |
| CN | 103954064 | A | 7/2014 |
| CN | 203771637 | U | 8/2014 |
| CN | 203824008 | U | 9/2014 |
| CN | 204006448 | U | 12/2014 |
| CN | 204084937 | U | 1/2015 |
| CN | 105222390 | A | 1/2016 |
| CN | 105333641 | A | 2/2016 |
| CN | 105737444 | A | 7/2016 |
| CN | 205783496 | U | 12/2016 |
| EP | 1437557 | A1 | 7/2004 |
| EP | 2549193 | A1 | 1/2013 |
| EP | 2610559 | A2 | 7/2013 |
| JP | 2016017731 | A | 2/2016 |
| WO | 2007121540 | A2 | 11/2007 |
| WO | 2014129935 | A1 | 8/2014 |
| WO | 2015023354 | A1 | 2/2015 |
| WO | 2016112158 | A1 | 7/2016 |

OTHER PUBLICATIONS

Chinese Office Action for Application No. 201710332939.1; dated Mar. 23, 2021; 8 Pages.
European Examiner Report for Application No. 18724766.3; dated Dec. 6, 2021; 4 Pages.

* cited by examiner

HEAT PUMP AND CONTROL METHOD THEREOF

TECHNICAL FIELD

The present invention relates to the field of air conditioning and domestic hot water supply devices, and more particularly to a heat pump system and a regulation method therefor.

BACKGROUND ART

At present, in order to provide a thermal energy use ratio, more and more heat pump systems begin to be added with a heat recovery heat exchanger and be configured with a heat recovery mode. At this moment, the heat pump system usually has a routine condenser, a routine evaporator, a heat recovery heat exchanger and several four-way valves, and realizes different working modes by selectively turning on some of the heat exchangers. However, four-way valves are mainly used to change the flow path direction, and if the on/off of a specific flow path needs to be controlled, an electromagnetic valve still needs to be provided on a corresponding flow path to perform on/off control. In addition, considering the structural design of valve body and the limitation on material cost, the electromagnetic valve currently used usually only has a one-way "shut down" function. Therefore, in order to ensure the turn-off of the flow path, a one-way globe valve also needs to be provided, in the flow direction where the electromagnetic valve cannot be completely "shut down", to match with the electromagnetic valve. As described above, in order to realize the heat recovery function of the heat pump system, a plurality of valves are additionally configured in the system, which will bring many problems in the process. On the one hand, the elements that need to be controlled by the system increase greatly and raise the control complexity; on the other hand, when impurity clogging appears in the valve, it may leak; and a large number of valves will increase the possibility of such leak, and excessive leak will further cause damage to the compressor. Therefore, the reliability of the heat pump system is reduced in many aspects.

SUMMARY OF THE INVENTION

The present invention is intended to provide a heat pump system and a control method therefor to solve the system reliability problem caused by too many valves that control the on/off of the flow paths in the heat pump system.

According to an aspect of the present invention, a heat pump system is provided, which comprises a compressor, a mode switch valve assembly, a mode switch flow path, and a first heat exchanger, a second heat exchanger and a heat recovery heat exchanger respectively connected between the mode switch valve assembly and the mode switch flow path; the mode switch flow path is provided with a first flow path, a second flow path and a third flow path which converge at an intersection point, and at least the first flow path and the second flow path are respectively provided with a throttling section, and the first flow path, the second flow path and the third flow path are controllably switched on/off to realize different function modes, wherein in a refrigeration mode, a circulation flow direction of a refrigeration medium is from an air outlet of the compressor to an air inlet of the compressor through the mode switch valve assembly, the first heat exchanger, the first flow path, the second flow path, the second heat exchanger, and the mode switch valve; and/or in a heating mode, the circulation flow direction of the refrigeration medium is from the air outlet of the compressor to the air inlet of the compressor through the mode switch valve assembly, the second heat exchanger, the second flow path, the first flow path, the first heat exchanger, and the mode switch valve assembly; and/or in a refrigeration heat recovery mode, the circulation flow direction of the refrigeration medium is from the air outlet of the compressor to the air inlet of the compressor through the mode switch valve assembly, the heat recovery heat exchanger, the third flow path, the second flow path, the second heat exchanger, and the mode switch valve assembly; and/or in a water heating mode, the circulation flow direction of the refrigeration medium is from the air outlet of the compressor to the air inlet of the compressor through the mode switch valve assembly, the heat recovery heat exchanger, the third flow path, the first flow path, the first heat exchanger, and the mode switch valve assembly.

According to another aspect of the present invention, a control method for a heat pump system is further provided, wherein the heat pump system comprises a compressor, a mode switch valve assembly, a mode switch flow path, and a first heat exchanger, a second heat exchanger and a heat recovery heat exchanger respectively connected between the mode switch valve assembly and the mode switch flow path; the mode switch flow path is provided with a first flow path, a second flow path and a third flow path which converge at an intersection point, and at least the first flow path and the second flow path are respectively provided with a throttling section; when a refrigeration mode is running, the mode switch valve assembly switches to a first position, turns on the first flow path and the second flow path of the mode switch flow path, and turns off the third flow path of the mode switch flow path; at this moment, a circulation flow direction of a refrigeration medium is from an air outlet of the compressor to an air inlet of the compressor through the mode switch valve assembly, the first heat exchanger, the first flow path, the second flow path, the second heat exchanger, and the mode switch valve assembly; and/or when a heating mode is running, the mode switch valve assembly switches to a second position, turns on the first flow path and the second flow path of the mode switch flow path, and turns off the third flow path of the mode switch flow path; at this moment, the circulation flow direction of the refrigeration medium is from the air outlet of the compressor to the air inlet of the compressor through the mode switch valve assembly, the second heat exchanger, the second flow path, the first flow path, the first heat exchanger, and the mode switch valve assembly; and/or when a refrigeration heat recovery mode is running, the mode switch valve assembly switches to a third position, turns on the second flow path and the third flow path of the mode switch flow path, and turns off the first flow path of the mode switch flow path; at this moment, the circulation flow direction of the refrigeration medium is from the air outlet of the compressor to the air inlet of the compressor through the mode switch valve assembly, the heat recovery heat exchanger, the third flow path, the second flow path, the second heat exchanger, and the mode switch valve assembly; and/or when a water heating mode is running, the mode switch valve assembly switches to a fourth position, turns on the first flow path and the third flow path of the mode switch flow path, and turns off the second flow path of the mode switch flow path; at this moment, the circulation flow direction of the refrigeration medium is from the air outlet of the compressor to the air inlet of the compressor through the mode switch valve assembly, the heat recovery heat exchanger, the third flow path, the first flow path, the first heat exchanger, and the mode switch valve assembly.

DETAILED DESCRIPTION

Figure 1:
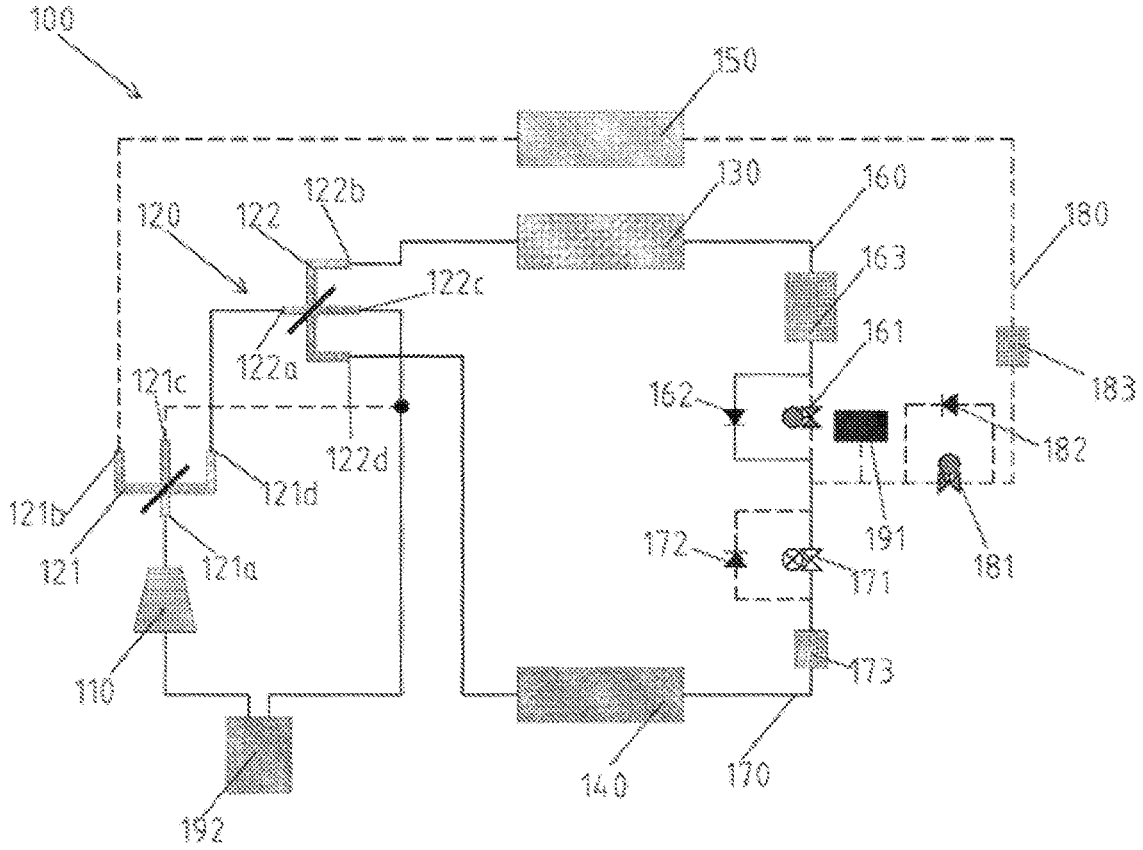
FIG. 1 is a schematic diagram of the system flow direction of an embodiment of a heat pump system of the present invention in a refrigeration mode.

As shown in FIG. 1 to FIG. 6, according to an embodiment of the present invention, a heat pump system 100 is provided. The heat pump system 100 comprises a compressor 110, a mode switch valve assembly 120, a first heat exchanger 130, a second heat exchanger 140, a heat recovery heat exchanger 150 and a mode switch flow path. The first heat exchanger 130, the second heat exchanger 140, and the heat recovery heat exchanger 150 are respectively connected between the mode switch valve assembly 120 and the mode switch flow path.

The mode switch flow path is provided with a first flow path, a second flow path and a third flow path which converge at an intersection point, and at least the first flow path and the second flow path are respectively provided with a throttling section, and the first flow path, the second flow path and the third flow path are controllably switched on/off to realize different function modes.

Applying the heat pump system in the previously stated embodiment, in the refrigeration mode, the circulation flow direction of the refrigeration medium is from the air outlet of the compressor 110 to the air inlet of the compressor 110 through the mode switch valve assembly 120, the first heat exchanger 130, the first flow path 160, the second flow path 170, the second heat exchanger 140, and the mode switch valve assembly 120; and/or in the heating mode, the circulation flow direction of the refrigeration medium is from the air outlet of the compressor 110 to the air inlet of the compressor 110 through the mode switch valve assembly 120, the second heat exchanger 140, the second flow path 170, the first flow path 160, the first heat exchanger 130, and the mode switch valve assembly 120; and/or in the refrigeration heat recovery mode, the circulation flow direction of the refrigeration medium is from the air outlet of the compressor 110 to the air inlet of the compressor 110 through the mode switch valve assembly 120, the heat recovery heat exchanger 150, the third flow path 180, the second flow path 170, the second heat exchanger 140, and the mode switch valve assembly 120; and/or in the water heating mode, the circulation flow direction of the refrigeration medium is from the air outlet of the compressor 110 to the air inlet of the compressor 110 through the mode switch valve assembly 120, the heat recovery heat exchanger 150, the third flow path 180, the first flow path 160, the first heat exchanger 130, and the mode switch valve assembly 120. Therefore, a heat pump unit having a heat recovery function is provided, which has advantages of simple structure and high operational reliability, etc.

The structure of each part of the heat pump system will be introduced in detail below.

In an embodiment, the on/off controllability of the first flow path 160 and the second flow path 170 will be associated with a throttling section provided thereupon. For example, the throttling section of the first flow path 160 comprises a first throttling element 161 and a first one-way valve 162 connected in parallel, and the first one-way valve 162 is turned on towards the intersection point and is turned off in the reverse direction; and/or the throttling section of the second flow path 170 comprises a second throttling element 171 and a second one-way valve 172 connected in parallel, and the second one-way valve 172 is turned on towards the intersection point and is turned off in the reverse direction, wherein both the first throttling element 161 and the second throttling element 171 can be "shut down" both ways. In this arrangement, an element that can be "shut down" both ways will be selected as the throttling element herein, so as to realize integration of the throttling and flow path on/off function, which greatly reduces the use of valves in comparison to the setting of an electromagnetic valve matching with a one-way valve or other similar arrangements.

In another embodiment, a throttling section is provided on the third flow path 180, which comprises a third throttling element 181 and a third one-way valve 182 connected in parallel, and the third one-way valve 182 is turned on towards the intersection point and is turned off in the reverse direction, wherein the third throttling element 181 can be "shut down" both ways. At this moment, an element that can be "shut down" both ways will be selected as the throttling element herein, so as to realize integration of the throttling and flow path on/off function, which greatly reduces the use of valves in comparison to the setting of an electromagnetic valve matching with a one-way valve or other similar arrangements.

Figure 7:
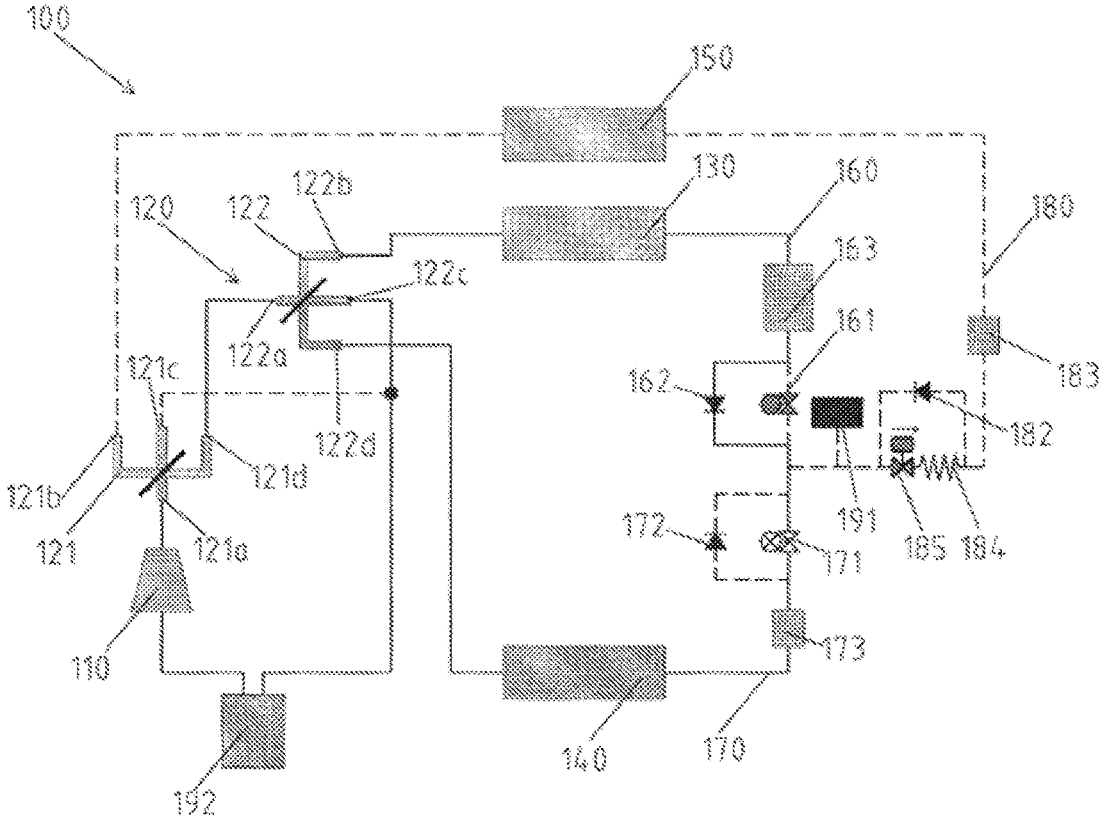
FIG. 7 is a schematic system diagram of another embodiment of the heat pump system of the present invention.

Alternatively, referring to FIG. 7, since the throttling section in the third flow path 180 usually is not applied to provide a throttling effect in various working modes of the previously stated embodiments, the throttling section in the third flow path 180 is adopted only in the defrost submode of the water heating mode to provide a throttling effect. Therefore, the requirement on the throttling performance of the throttling section herein does not need to be too high. Based on this consideration, the throttling section of the third flow path 180 comprises a throttling assembly and a third one-way valve 182 connected in parallel, the third one-way valve 182 is turned on towards the intersection point and is turned off in the reverse direction, and the throttling assembly comprises a throttling capillary tube 184 and an electromagnetic valve 185, wherein the electromagnetic valve 185 can be turned on against the intersection point and be "shut down" in the reverse direction.

For the first throttling element 161, the second throttling element 171 and the third throttling element 181 mentioned above, to ensure that they also have the function to realize throttling and flow path on/off control, as an example, an electronic expansion valve can be adopted.

In addition, the mode switch valve assembly 120 in the previously stated embodiments has a first switch position, a second switch position, a third switch position and a fourth switch position. In the first switch position, the mode switch valve assembly 120 respectively communicates with the air outlet of the compressor 110 and the first heat exchanger 130; and the air inlet of the compressor 110 and the second heat exchanger 140; and/or in the second switch position, the mode switch valve assembly 120 respectively communicates with the air outlet of the compressor 110 and the second heat exchanger 140; and the air inlet of the compressor 110 and the first heat exchanger 130; and/or in the third switch position, the mode switch valve assembly 120 respectively communicates with the air outlet of the compressor 110 and the heat recovery heat exchanger 150; and the air inlet of the compressor 110 and the second heat exchanger 140; and/or in the fourth switch position, the mode switch valve assembly 120 respectively communicates with the air outlet of the compressor 110 and the heat recovery heat exchanger 150; and the air inlet of the compressor 110 and the first heat exchanger 130.

It should be known that the mode switch valve assembly 120 of the present invention can be either a one-way valve or a combination of a plurality of valves, for example, it can be a five-way valve or a combination of two four-way valves, as long as the mode switch valve assembly 120 can realize respective connection with the air inlet and air outlet of the compressor 110, the first heat exchanger 130, the second heat exchanger 140, and the heat recovery heat exchanger 150 mentioned in this embodiment. With regard to the specific connection mode thereof, there can be a plurality of them, and the present invention proposes one of the preferential solutions. However, according to the teaching of the present conception about the connection mode, it is very easy for a person skilled in the art to modify or adjust, without inventive efforts, the connection mode of each port of the mode switch valve assembly 120 and the air inlet and air outlet of the compressor 110, the first heat exchanger 130, the second heat exchanger 140, the heat recovery heat exchanger 150 and other components, and this type of modification or adjustment should be incorporated in the scope of protection of the present invention.

This specification will explain an optional connection mode in detail in conjunction with FIG. 1 to FIG. 6. At this moment, the mode switch valve assembly comprises a first four-way valve 121 and a second four-way valve 122; the first four-way valve 121 has an a1 port 121*a*, a b1 port 121*b*, a c1 port 121*c* and a d1 port 121*d*, and the second four-way valve 122 has an a2 port 122*a*, a b2 port 122*b*, a c2 port 122*c* and a d2 port 122*d*, wherein the a1 port 121*a* is connected to the air outlet of the compressor 110, the b1 port 121*b* is connected to the heat recovery heat exchanger 150, the c1 port 121*c* is connected to the air inlet of the compressor 110, the d1 port 121*d* is connected to the a2 port 122*a*, the b2 port 122*b* is connected to the first heat exchanger 130, the c2 port 122*c* is connected to the air inlet of the compressor 110, and the d2 port 122*d* is connected to the second heat exchanger 140.

In the first switch position, the a1 port 121*a* communicates with the d1 port 121*d*, the b1 port 121*b* communicates with the c1 port 121*c*, the a2 port 122*a* communicates with the b2 port 122*b*, and the c2 port 122*c* communicates with the d2 port 122*d*; and/or in the second switch position, the a1 port 121*a* communicates with the d1 port 121*d*, the b1 port 121*b* communicates with the c1 port 121*c*, the a2 port 122*a* communicates with the d2 port 122*d*, and the b2 port 122*b* communicates with the c2 port 122*c*; and/or in the third switch position, the a1 port 121*a* communicates with the b1 port 121*b*, the c1 port 121*c* communicates with the d1 port 121*d*, the a2 port 122*a* communicates with the b2 port 122*b*, and the c2 port 122*c* communicates with the d2 port 122*d*; and/or in the fourth switch position, the a1 port 121*a* communicates with the b1 port 121*b*, the c1 port 121*b* communicates with the d1 port 121*c*, the a2 port 122*a* communicates with the d2 port 122*d*, and the b2 port 122*b* communicates with the c2 port 122*c*.

In addition, the third flow path 180 is provided with a reservoir 191 and the reservoir 191 has a common pipeline used for both liquid inlet and liquid outlet, and the reservoir 191 is provided near the intersection point on the third flow path 180, so as to reserve some refrigerant in the working condition of excessive refrigerant and/or discharge the refrigerant in the working condition of full load refrigerant. Alternatively, it is also possible to make the refrigerant not flow through the reservoir 191 in the working condition of full load refrigerant. More specifically, the common pipeline stretches from the bottom of the reservoir 191 into the reservoir 191 so that there will not be excessive refrigerant remained in the reservoir 191 due to structure design when it is needed to discharge the refrigerant.

Alternatively, dry filters 163, 173, 183 are respectively provided on the first flow path 160, the second flow path 170 and the third flow path 180. More specifically, the dry filters 163, 173, 183 are respectively provided upstream of the throttling sections of the first flow path 160, the second flow path 170 and the third flow path 180, so as to filter the refrigerant before expansion and throttling.

Alternatively, a gas-liquid separator 192 can also be provided at the air inlet of the compressor 110 to prevent the liquid refrigerant from entering the compressor 110 and thus cause a liquid impact phenomenon.

According to the above specific introduction to the mode switch flow path, each throttling section and the mode switch valve assembly and the due understanding of the person skilled in the art to other routine refrigeration components, by controlling, via power on/off, the position switching of the mode switch valve assembly and the on/off and/or throttling state of each throttling section in the mode switch flow path, the heat pump system can realize at least four different types of refrigerant flow circulation, and therefore, at least four different types of air adjustment and/or hot water preparation working modes can be realized.

According to another aspect, a control method for a heat pump system is also provided herein, which can be directly applied in the heat pump system mentioned in the previously stated embodiments or be applied in a heat pump system comprising at least the following components. The heat pump system comprises a compressor 110, a mode switch valve assembly 120, a mode switch flow path, and a first heat exchanger 130, a second heat exchanger 140 and a heat recovery heat exchanger 150 respectively connected between the mode switch valve assembly 120 and the mode switch flow path, wherein the mode switch flow path is provided with a first flow path 160, a second flow path 170 and a third flow path 180 which converge at an intersection point, and at least the first flow path 160 and the second flow path 170 are respectively provided with a throttling section.

Specifically, when a refrigeration mode is running, the mode switch valve assembly 120 switches to a first position, turns on the first flow path 160 and the second flow path 170 of the mode switch flow path, and turns off the third flow path 180 of the mode switch flow path; at this moment, a circulation flow direction of a refrigeration medium is from an air outlet of the compressor 110 to an air inlet of the compressor 110 through the mode switch valve assembly 120, the first heat exchanger 130, the first flow path 160, the second flow path 170, the second heat exchanger 140, and the mode switch valve assembly 120; and/or when a heating mode is running, the mode switch valve assembly 120 switches to a second position, turns on the first flow path 160 and the second flow path 170 of the mode switch flow path, and turns off the third flow path 180 of the mode switch flow path; at this moment, the circulation flow direction of the refrigeration medium is from the air outlet of the compressor 110 to the air inlet of the compressor 110 through the mode switch valve assembly 120, the second heat exchanger 140, the second flow path 170, the first flow path 160, the first heat exchanger 130, and the mode switch valve assembly 120; and/or when a refrigeration heat recovery mode is running, the mode switch valve assembly 120 switches to a third position, turns on the second flow path 170 and the third flow path 180 of the mode switch flow path, and turns off the first flow path 160 of the mode switch flow path; at this moment, the circulation flow direction of the refrigeration medium is from the air outlet of the compressor 110 to the air inlet of the compressor 110 through the mode switch valve assembly 120, the heat recovery heat exchanger 150, the third flow path 180, the second flow path 170, the second heat exchanger 140, and the mode switch valve assembly 120; and/or when a water heating mode is running, the mode switch valve assembly 120 switches to a fourth position, turns on the first flow path 160 and the third flow path 180 of the mode switch flow path, and turns off the second flow path 170 of the mode switch flow path; at this moment, the circulation flow direction of the refrigeration medium is from the air outlet of the compressor 110 to the air inlet of the compressor 110 through the mode switch valve assembly 120, the heat recovery heat exchanger 150, the third flow path 180, the first flow path 160, the first heat exchanger 130, and the mode switch valve assembly 120. Therefore, a control method for a heat pump unit having a heat recovery function is provided, which has advantages of simple structure and high operational reliability, etc.

Optionally, in the heat pump system applied, the throttling section of the first flow path 160 comprises a first throttling element 161 and a first one-way valve 162 connected in parallel, and the first one-way valve 162 is turned on towards the intersection point and is turned off in the reverse direction; and/or the throttling section of the second flow path 170 comprises a second throttling element 171 and a second one-way valve 172 connected in parallel, and the second one-way valve 172 is turned on towards the intersection point and is turned off in the reverse direction.

At this moment, when the refrigeration mode is operating, the first throttling element 161 is off, and the second throttling element 171 is on and provides a throttling effect; when the heating mode is operating, the second throttling element 171 is off, and the first throttling element 161 is on and provides a throttling effect; when the refrigeration heat recovery mode is operating, the first throttling element 161 is off, and the second throttling element 171 is on and provides a throttling effect; and when the water heating mode is operating, the second throttling element 171 is off, and the first throttling element 161 is on and provides a throttling effect. Here, the functions of the first throttling element 161 and the second throttling element 171 in different working modes are illustrated.

Figure 5:
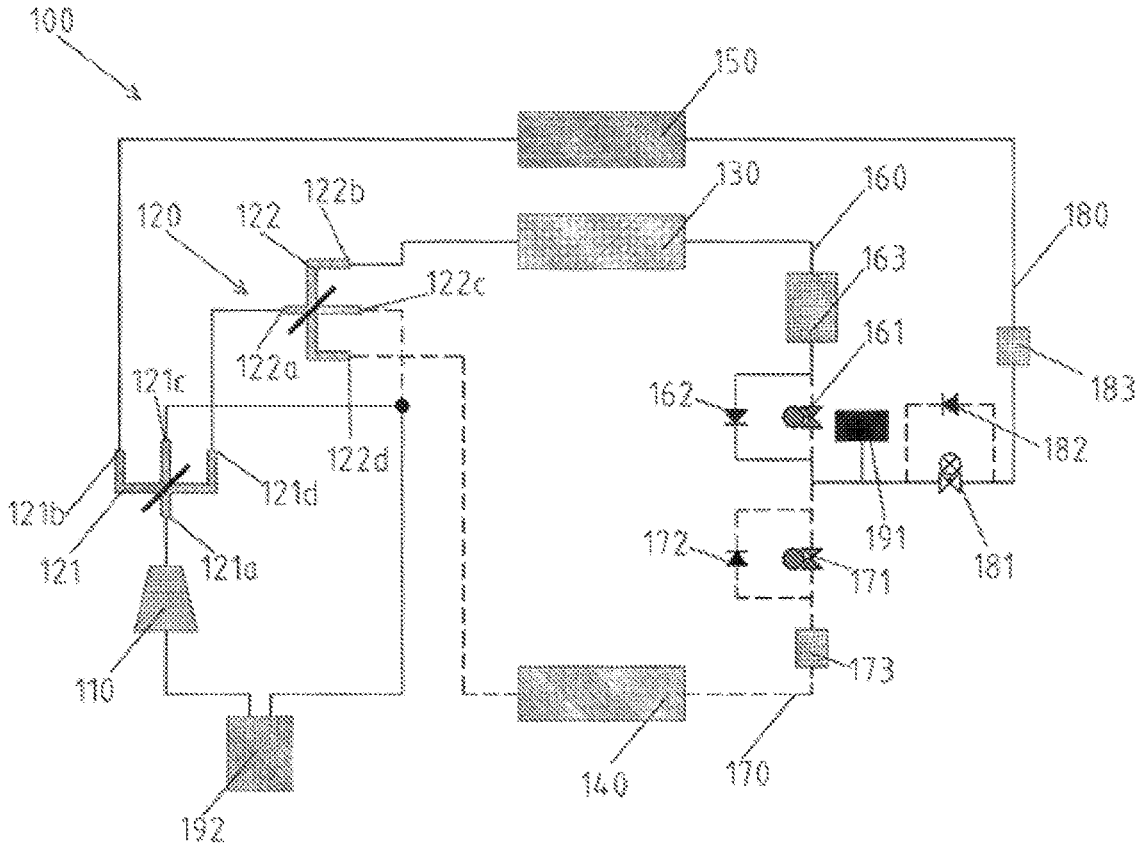
FIG. 5 is a schematic diagram of the system flow direction of an embodiment of the heat pump system of the present invention in a defrost submode of the water heating mode.

At this moment, a defrost submode is also set as a precaution and remedial measure for harsh working conditions. When the defrost submode is running under the water heating mode, as shown in FIG. 5, the first flow path 160 and the third flow path 180 of the mode switch flow path are turned on, and the second flow path 170 of the mode switch flow path is turned off; at this moment, the circulation flow direction of the refrigeration medium is from the air outlet of the compressor 110 to the air inlet of the compressor 110 through the mode switch valve assembly 120, the first heat exchanger 130, the first flow path 160, the third flow path 180, the heat recovery heat exchanger 150, and the mode switch valve assembly 120. At this moment, the frosting problem of the first heat exchanger 130 can be effectively avoided.

Optionally, in the applied heat pump system, a throttling section is provided on the third flow path 180, which comprises a third throttling element 181 and a third one-way valve 182 connected in parallel, and the third one-way valve 182 is turned off one way towards the intersection point; at this moment, the third throttling element 181 is on when the defrost submode is operating.

In another alternative embodiment shown in FIG. 7, the throttling section of the third flow path 180 comprises a throttling assembly and the third one-way valve 182 connected in parallel, the third one-way valve 182 is turned on towards the intersection point and is turned off in the reverse direction, and the throttling assembly comprises a throttling capillary tube 184 and an electromagnetic valve 185, wherein the third throttling element 181 and the electromagnetic valve 185 are on when the defrost submode is operating.

Optionally, when the defrost submode is running under the heating mode, the first flow path 160 and the second flow path 170 of the mode switch flow path are turned on, and the third flow path 180 of the mode switch flow path is turned off; at this moment, the circulation flow direction of the refrigeration medium is from the air outlet of the compressor 110 to the air inlet of the compressor 110 through the mode switch valve assembly 120, the first heat exchanger 130, the first flow path 160, the second flow path 170, the second heat exchanger 140, and the mode switch valve assembly 120. At this moment, the frosting problem of the first heat exchanger 130 can be effectively avoided.

Moreover, as a further improvement to the previously stated control method, the method can further comprise a combined function mode. The combined function mode comprises a preset condition, a first running mode and a second running mode, wherein the first running mode is any one of the refrigeration mode, the heating mode, the refrigeration heat recovery mode or the water heating mode, and the second running mode is any other one of the refrigeration mode, the heating mode, the refrigeration heat recovery mode or the water heating mode; and when the combined function mode is running, if the first running mode is run first, after the preset condition is satisfied, the second running mode is switched to. Specifically, the preset condition mentioned in the embodiments is that the air temperature and/or water temperature satisfies a preset value.

As a specific implementation of the combined function mode, it comprises a heating and heat recovery mode; and the first running mode is any one of the heating mode or the water heating mode, and the second running mode is any other one of the heating mode or the water heating mode. When the heating and heat recovery mode is running, if the first running mode is run first, after the preset condition is satisfied, the second running mode is switched to.

The working process of the heat pump system in contrast to the previously stated embodiments is described below in conjunction with FIG. 1 to FIG. 7. It should be noted that in the accompanying drawings different forms of lines are used to indicate the working state of each pipeline. Here, a full line indicates that a pipeline has participated in the current working mode, while a dashed line indicates that a pipeline does not participate in the current working mode.

Referring to FIG. 1, when the refrigeration mode is running, the first throttling element 161 and the third throttling element 181 are off, and the second throttling element 171 is on. At this moment, the high-pressure high-temperature refrigerant flows out of the air outlet of the compressor 110, passes through the first four-way valve a1 port 121*a*, the first four-way valve d1 port 121*d*, the second four-way valve a2 port 122*a*, and the second four-way valve b2 port 122*b*, and flows into the first heat exchanger 130 to discharge heat. Then the high-pressure medium-temperature refrigerant that flowed out is filtered in the dry filter 163, and directly flows through the first one-way valve 162, enters the second throttling element 171 and is throttled into low-pressure low-temperature refrigerant. After being again filtered by the dry filter 173, the low-pressure low-temperature refrigerant flows into the second heat exchanger 140 to absorb heat, and then low-pressure medium-temperature refrigerant flows out and successively passes through the second four-way valve d2 port 122*d*, the second four-way valve c2 port 122*c* and the gas-liquid separator 192 and flows back to the air inlet of the compressor 110, thereby completing the operation of the refrigeration mode.

Figure 2:
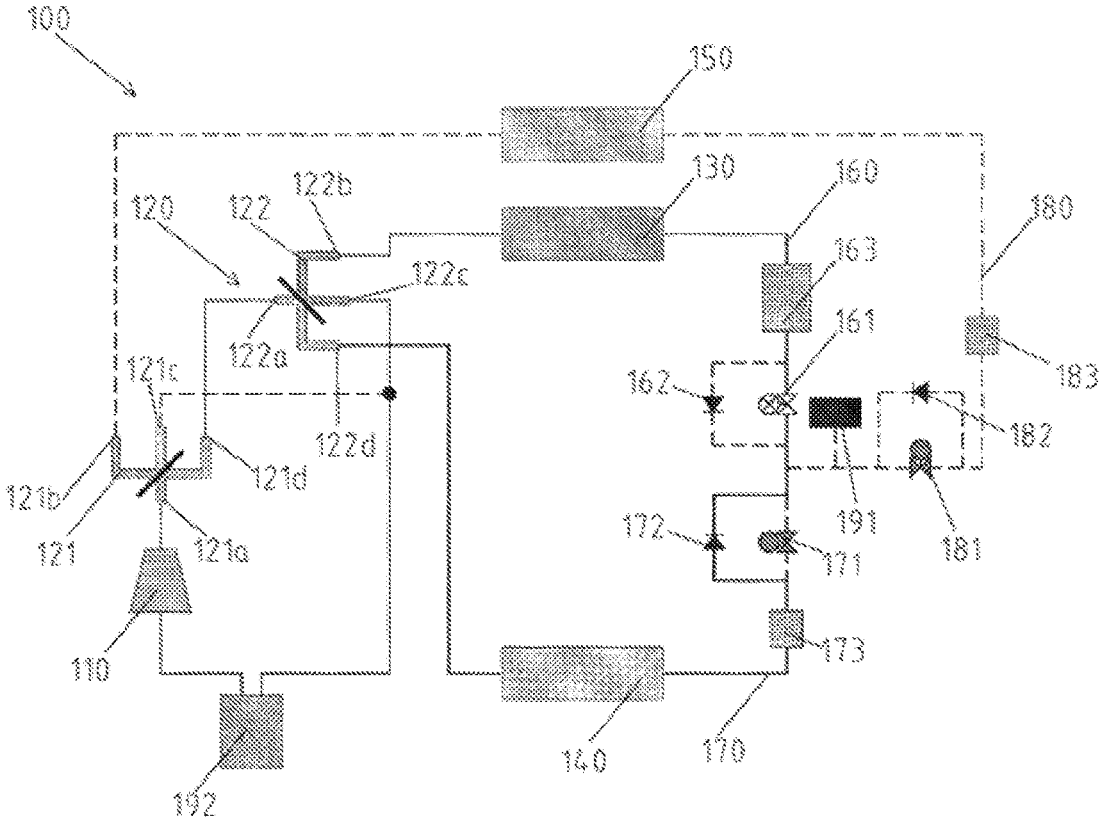
FIG. 2 is a schematic diagram of the system flow direction of an embodiment of the heat pump system of the present invention in a heating mode.

Referring to FIG. 2, when the heating mode is running, the second throttling element 171 and the third throttling element 181 are off, and the first throttling element 161 is on. At this moment, the high-pressure high-temperature refrigerant flows out of the air outlet of the compressor 110, passes through the first four-way valve a1 port 121*a*, the first four-way valve d1 port 121*d*, the second four-way valve a2 port 122*a*, and the second four-way valve d2 port 122*d*, and flows into the second heat exchanger 140 to discharge heat. Then the high-pressure medium-temperature refrigerant that flowed out is filtered in the dry filter 173, and directly flows through the second one-way valve 172, enters the first throttling element 161 and is throttled into low-pressure low-temperature refrigerant. After being again filtered by the dry filter 163, the low-pressure low-temperature refrigerant flows into the first heat exchanger 130 to absorb heat, and then low-pressure medium-temperature refrigerant flows out and successively passes through the second four-way valve b2 port 122*b*, the second four-way valve c2 port 122*c* and the gas-liquid separator 192 and flows back to the air inlet of the compressor 110, thereby completing the operation of the heating mode.

Figure 3:
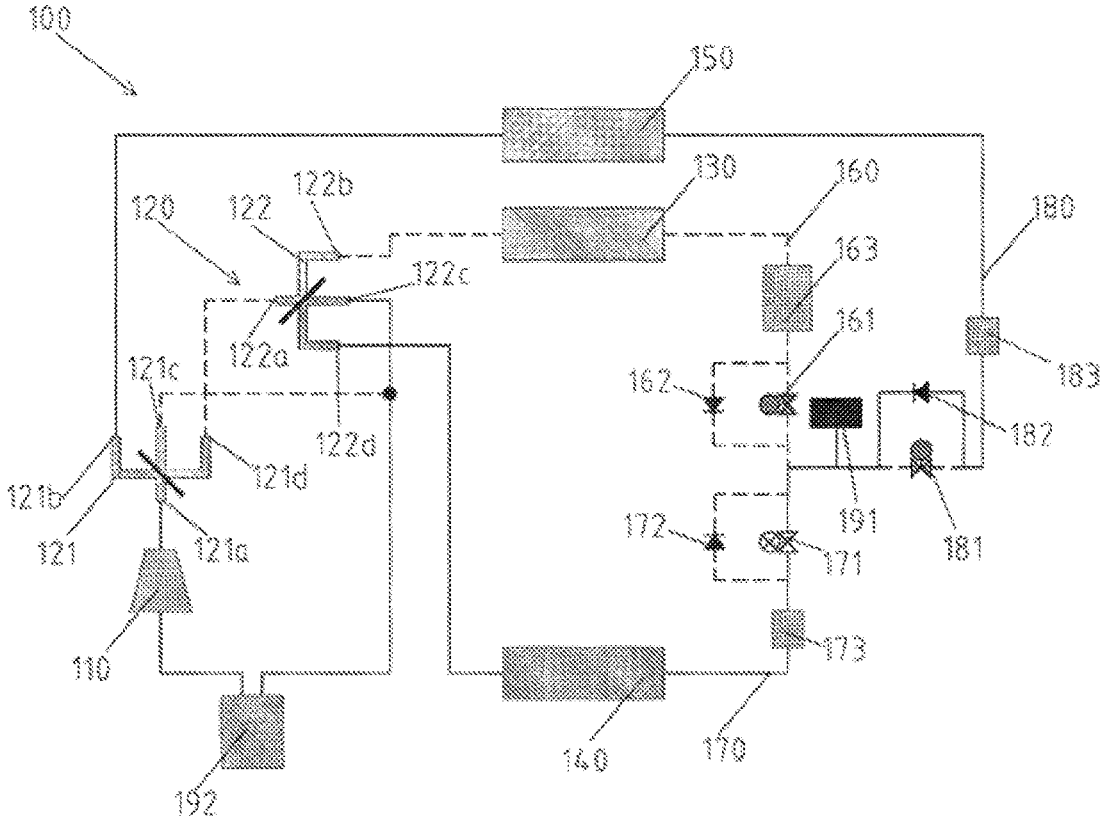
FIG. 3 is a schematic diagram of the system flow direction of an embodiment of the heat pump system of the present invention in a refrigeration heat recovery mode.

Referring to FIG. 3, when the refrigeration heat recovery mode is running, the first throttling element 161 and the third throttling element 181 are off, and the second throttling element 171 is on. At this moment, the high-pressure high-temperature refrigerant flows out of the air outlet of the compressor 110, passes through the first four-way valve a1 port 121*a* and the first four-way valve b1 port 121*b*, and flows into the heat recovery heat exchanger 150 to discharge heat. Then the high-pressure medium-temperature refrigerant that flowed out is filtered in the dry filter 183, and directly flows through the third one-way valve 182, enters the second throttling element 171 and is throttled into low-pressure low-temperature refrigerant. After being again filtered by the dry filter 173, the low-pressure low-temperature refrigerant flows into the second heat exchanger 140 to absorb heat, and then low-pressure medium-temperature refrigerant flows out and successively passes through the second four-way valve d2 port 122*d*, the second four-way valve c2 port 122*c* and the gas-liquid separator 192 and flows back to the air inlet of the compressor 110, thereby completing the operation of the refrigeration heat recovery mode.

Figure 4:
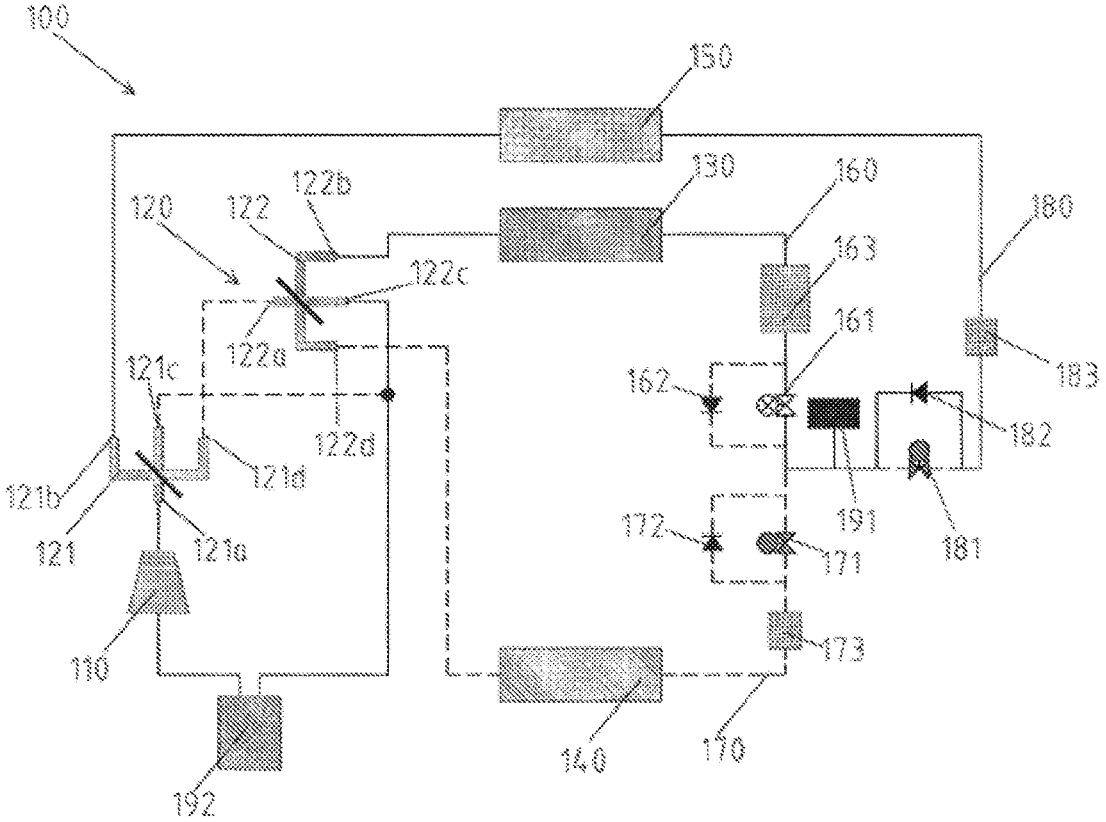
FIG. 4 is a schematic diagram of the system flow direction of an embodiment of the heat pump system of the present invention in a water heating mode.

Referring to FIG. 4, when the water heating mode is running, the second throttling element 171 and the third throttling element 181 are off, and the first throttling element 161 is on. At this moment, the high-pressure high-temperature refrigerant flows out of the air outlet of the compressor 110, passes through the first four-way valve a1 port 121*a* and the first four-way valve b1 port 121*b*, and flows into the heat recovery heat exchanger 150 to discharge heat. Then the high-pressure medium-temperature refrigerant that flowed out is filtered in the dry filter 183, and directly flows through the third one-way valve 182, enters the first throttling element 161 and is throttled into low-pressure low-temperature refrigerant. After being again filtered by the dry filter 163, the low-pressure low-temperature refrigerant flows into the first heat exchanger 130 to absorb heat, and then low-pressure medium-temperature refrigerant flows out and successively passes through the second four-way valve b2 port 122*b*, the second four-way valve c2 port 122*c* and the gas-liquid separator 192 and flows back to the air inlet of the compressor 110, thereby completing the operation of the water heating mode.

Referring to FIG. 5, when the defrost submode of the water heating mode is running, the first throttling element 161 and the second throttling element 171 are off, and the third throttling element 181 is on. At this moment, the high-pressure high-temperature refrigerant flows out of the air outlet of the compressor 110, passes through the first four-way valve a1 port 121*a*, the first four-way valve d1 port 121*d*, the second four-way valve a2 port 121*a*, and the second four-way valve b2 port 121*b*, and flows into the first heat exchanger 130 to discharge heat. Then the high-pressure medium-temperature refrigerant that flowed out is filtered in the dry filter 163, and directly flows through the first one-way valve 162, enters the third throttling element 181 and is throttled into low-pressure low-temperature refrigerant. After being again filtered by the dry filter 183, the low-pressure low-temperature refrigerant flows into the heat recovery heat exchanger 150 to absorb heat, and then low-pressure medium-temperature refrigerant flows out and successively passes through the first four-way valve b1 port 121*b*, the second four-way valve c1 port 121*c* and the gas-liquid separator 192 and flows back to the air inlet of the compressor 110, thereby completing the operation of the defrost submode.

Figure 6:
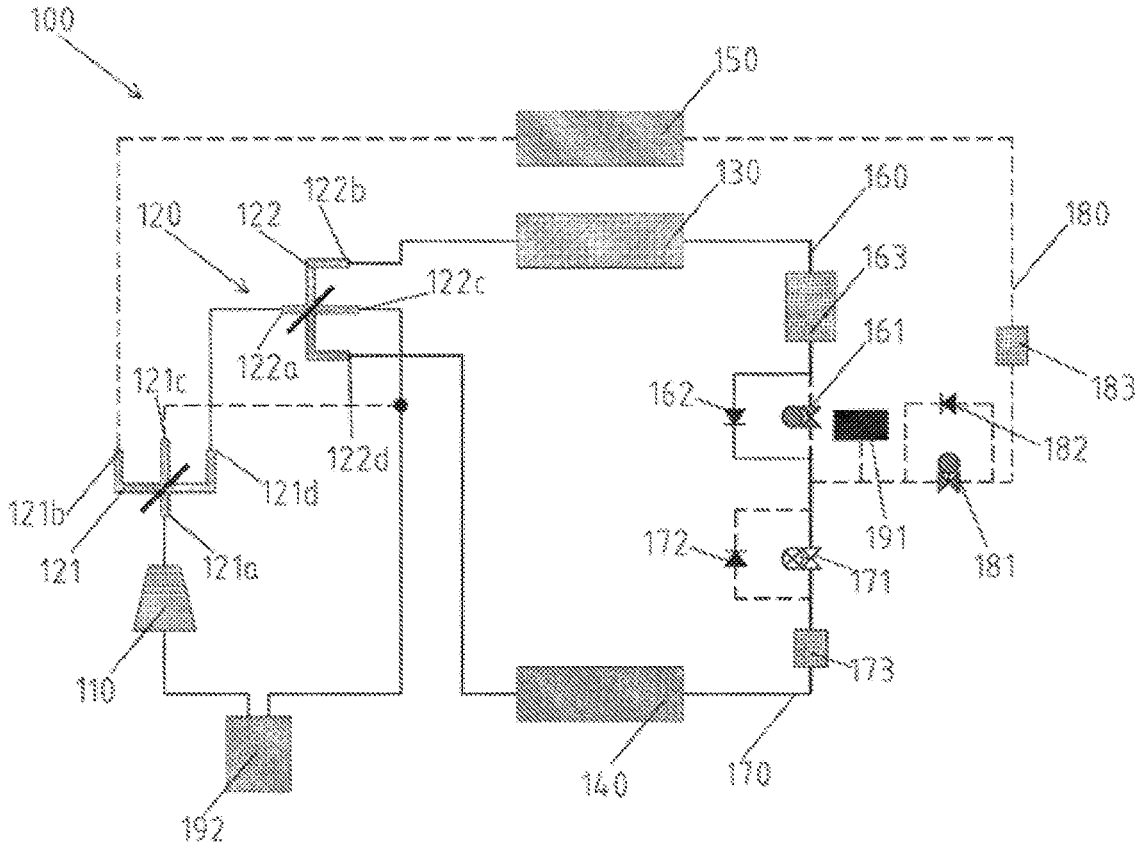
FIG. 6 is a schematic diagram of the system flow direction of an embodiment of the heat pump system of the present invention in a defrost submode of the heating mode.

Referring to FIG. 6, when the defrost submode of the heating mode is running, the first throttling element 161 and the third throttling element 181 are off, and the second throttling element 171 is on. At this moment, the high-pressure high-temperature refrigerant flows out of the air outlet of the compressor 110, passes through the first four-way valve a1 port 121*a*, the first four-way valve d1 port 121*d*, the second four-way valve a2 port 122*a*, and the second four-way valve b2 port 122*b*, and flows into the first heat exchanger 130 to discharge heat. Then the high-pressure medium-temperature refrigerant that flowed out is filtered in the dry filter 163, and directly flows through the first one-way valve 162, enters the second throttling element 171 and is throttled into low-pressure low-temperature refrigerant. After being again filtered by the dry filter 173, the low-pressure low-temperature refrigerant flows into the second heat exchanger 140 to absorb heat, and then low-pressure medium-temperature refrigerant flows out and successively passes through the second four-way valve d2 port 122*d*, the second four-way valve c2 port 122*c* and the gas-liquid separator 192 and flows back to the air inlet of the compressor 110, thereby completing the operation of the defrost submode.

Referring to FIG. 7, as another embodiment, when the refrigeration mode is running, the first throttling element 161 and the electromagnetic valve 185 are off, and the second throttling element 171 is on. At this moment, the high-pressure high-temperature refrigerant flows out of the air outlet of the compressor 110, passes through the first four-way valve a1 port 121*a*, the first four-way valve d1 port 121*d*, the second four-way valve a2 port 122*a*, and the second four-way valve b2 port 122*b*, and flows into the first heat exchanger 130 to discharge heat. Then the high-pressure medium-temperature refrigerant that flowed out is filtered in the dry filter 163, and directly flows through the first one-way valve 162, enters the second throttling element 171 and is throttled into low-pressure low-temperature refrigerant. After being again filtered by the dry filter 173, the low-pressure low-temperature refrigerant flows into the second heat exchanger 140 to absorb heat, and then low-pressure medium-temperature refrigerant flows out and successively passes through the second four-way valve d2 port 122*d*, the second four-way valve c2 port 122*c* and the gas-liquid separator 192 and flows back to the air inlet of the compressor 110, thereby completing the operation of the refrigeration mode.

The above examples mainly explain the heat pump system and the control method therefor of the present invention. Although only some of the implementations of the present invention are described, a person of ordinary skill in the art should understand that the present invention can be implemented in many other forms without deviating from the purpose and scope thereof. Therefore, the illustrated examples and implementations are deemed as schematic rather than restrictive, and the present invention may cover various modifications and substitutions without deviating from the spirit and scope of the present invention defined by each of the attached claims.

The invention claimed is:

1. A heat pump system comprising a compressor, a mode switch valve assembly, a first heat exchanger, a second heat exchanger and a heat recovery heat exchanger;

a first flow path, a second flow path and a third flow path which converge at an intersection point, and at least the first flow path and the second flow path are respectively provided with a throttling section, and the first flow path, the second flow path and the third flow path are controllably switched on/off to realize different function modes, wherein in a refrigeration mode, a circulation flow direction of a refrigeration medium is from an outlet of the compressor to an inlet of the compressor through the mode switch valve assembly, the first heat exchanger, the first flow path, the second flow path, the second heat exchanger, and the mode switch valve; and/or in a heating mode, the circulation flow direction of the refrigeration medium is from the outlet of the compressor to the inlet of the compressor through the mode switch valve assembly, the second heat exchanger, the second flow path, the first flow path, the first heat exchanger, and the mode switch valve assembly; and/or in a refrigeration heat recovery mode, the circulation flow direction of the refrigeration medium is from the outlet of the compressor to the inlet of the compressor through the mode switch valve assembly, the heat recovery heat exchanger, the third flow path, the second flow path, the second heat exchanger, and the mode switch valve assembly; and/or in a water heating mode, the circulation flow direction of the refrigeration medium is from the outlet of the compressor to the inlet of the compressor through the mode switch valve assembly, the heat recovery heat exchanger, the third flow path, the first flow path, the first heat exchanger, and the mode switch valve assembly;

wherein the throttling section of the first flow path comprises a first throttling element and a first one-way valve connected in parallel, and the first one-way valve is turned on towards the intersection point and is turned off in the reverse direction; and/or wherein the throttling section of the second flow path comprises a second throttling element and a second one-way valve connected in parallel, and the second one-way valve is turned on towards the intersection point and is turned off one way in the reverse direction, wherein both the first throttling element and the second throttling element can be shut down both ways.

2. A heat pump system comprising a compressor, a mode switch valve assembly, a first heat exchanger, a second heat exchanger and a heat recovery heat exchanger;

a first flow path, a second flow path and a third flow path which converge at an intersection point, and at least the first flow path and the second flow path are respectively provided with a throttling section, and the first flow path, the second flow path and the third flow path are controllably switched on/off to realize different function modes, wherein in a refrigeration mode, a circulation flow direction of a refrigeration medium is from an outlet of the compressor to an inlet of the compressor through the mode switch valve assembly, the first heat exchanger, the first flow path, the second flow path, the second heat exchanger, and the mode switch valve; and/or in a heating mode, the circulation flow direction of the refrigeration medium is from the outlet of the compressor to the inlet of the compressor through the mode switch valve assembly, the second heat exchanger, the second flow path, the first flow path, the first heat exchanger, and the mode switch valve assembly; and/or in a refrigeration heat recovery mode, the circulation flow direction of the refrigeration medium is from the outlet of the compressor to the inlet of the compressor through the mode switch valve assembly, the heat recovery heat exchanger, the third flow path, the second flow path, the second heat exchanger, and the mode switch valve assembly; and/or in a water heating mode, the circulation flow direction of the refrigeration medium is from the outlet of the compressor to the inlet of the compressor through the mode switch valve assembly, the heat recovery heat exchanger, the third flow path, the first flow path, the first heat exchanger, and the mode switch valve assembly;

wherein a throttling section is provided on the third flow path, which comprises a third throttling element and a third one-way valve connected in parallel, and the third one-way valve is turned on towards the intersection point and is turned off in the reverse direction, wherein the third throttling element can be shut down both ways.

3. The heat pump system according to claim 2, wherein:

the throttling section of the third flow path comprises a throttling assembly and the third one-way valve connected in parallel, the third one-way valve is turned on towards the intersection point and is turned off in the reverse direction, and the throttling assembly comprises a throttling capillary tube and an electromagnetic valve, wherein the electromagnetic valve can be turned on against the intersection point and be shut down in the reverse direction.

4. The heat pump system according to claim 1, wherein the first flow path or the second flow path or the third flow path is provided with a reservoir and the reservoir has a common pipeline used for both liquid inlet and liquid outlet.

5. A heat pump system comprising a compressor, a mode switch valve assembly, a first heat exchanger, a second heat exchanger and a heat recovery heat exchanger;

a first flow path, a second flow path and a third flow path which converge at an intersection point, and at least the first flow path and the second flow path are respectively provided with a throttling section, and the first flow path, the second flow path and the third flow path are controllably switched on/off to realize different function modes, wherein in a refrigeration mode, a circulation flow direction of a refrigeration medium is from an outlet of the compressor to an inlet of the compressor through the mode switch valve assembly, the first heat exchanger, the first flow path, the second flow path, the second heat exchanger, and the mode switch valve; and/or in a heating mode, the circulation flow direction of the refrigeration medium is from the outlet of the compressor to the inlet of the compressor through the mode switch valve assembly, the second heat exchanger, the second flow path, the first flow path, the first heat exchanger, and the mode switch valve assembly; and/or in a refrigeration heat recovery mode, the circulation flow direction of the refrigeration medium is from the outlet of the compressor to the inlet of the compressor through the mode switch valve assembly, the heat recovery heat exchanger, the third flow path, the second flow path, the second heat exchanger, and the mode switch valve assembly; and/or in a water heating mode, the circulation flow direction of the refrigeration medium is from the outlet of the compressor to the inlet of the compressor through the mode switch valve assembly, the heat recovery heat exchanger, the third flow path, the first flow path, the first heat exchanger, and the mode switch valve assembly;

wherein the first flow path or the second flow path or the third flow path is provided with a reservoir and the reservoir has a common pipeline used for both liquid inlet and liquid outlet:

wherein the common pipeline stretches from the bottom of the reservoir into the reservoir.

6. The heat pump system according to claim 4, wherein the reservoir is provided near the intersection point on the first flow path or the second flow path or the third flow path.

7. The heat pump system according to claim 2, wherein a dry filter is respectively provided upstream of the throttling sections of the first flow path, the second flow path and the third flow path.

8. The heat pump system according to claim 1, wherein:

the mode switch valve assembly has a first switch position, a second switch position, a third switch position and a fourth switch position, wherein in the first switch position, the mode switch valve assembly respectively communicates with the outlet of the compressor and the first heat exchanger; and the inlet of the compressor and the second heat exchanger; and/or in the second switch position, the mode switch valve assembly respectively communicates with the outlet of the compressor and the second heat exchanger; and the inlet of the compressor and the first heat exchanger; and/or in the third switch position, the mode switch valve assembly respectively communicates with the outlet of the compressor and the heat recovery heat exchanger; and the inlet of the compressor and the second heat exchanger; and/or in the fourth switch position, the mode switch valve assembly respectively communicates with the outlet of the compressor and the heat recovery heat exchanger; and the inlet of the compressor and the first heat exchanger.

9. A heat pump system comprising a compressor, a mode switch valve assembly, a first heat exchanger, a second heat exchanger and a heat recovery heat exchanger;

a first flow path, a second flow path and a third flow path which converge at an intersection point, and at least the first flow path and the second flow path are respectively provided with a throttling section, and the first flow path, the second flow path and the third flow path are controllably switched on/off to realize different function modes, wherein in a refrigeration mode, a circulation flow direction of a refrigeration medium is from an outlet of the compressor to an inlet of the compressor through the mode switch valve assembly, the first heat exchanger, the first flow path, the second flow path, the second heat exchanger, and the mode switch valve; and/or in a heating mode, the circulation flow direction of the refrigeration medium is from the outlet of the compressor to the inlet of the compressor through the mode switch valve assembly, the second heat exchanger, the second flow path, the first flow path, the first heat exchanger, and the mode switch valve assembly; and/or in a refrigeration heat recovery mode, the circulation flow direction of the refrigeration medium is from the outlet of the compressor to the inlet of the compressor through the mode switch valve assembly, the heat recovery heat exchanger, the third flow path, the second flow path, the second heat exchanger, and the mode switch valve assembly; and/or in a water heating mode, the circulation flow direction of the refrigeration medium is from the outlet of the compressor to the inlet of the compressor through the mode switch valve assembly, the heat recovery heat exchanger, the third flow path, the first flow path, the first heat exchanger, and the mode switch valve assembly;

wherein:

the mode switch valve assembly has a first switch position, a second switch position, a third switch position and a fourth switch position, wherein in the first switch position, the mode switch valve assembly respectively communicates with the outlet of the compressor and the first heat exchanger; and the inlet of the compressor and the second heat exchanger; and/or in the second switch position, the mode switch valve assembly respectively communicates with the outlet of the compressor and the second heat exchanger; and the inlet of the compressor and the first heat exchanger; and/or in the third switch position, the mode switch valve assembly respectively communicates with the outlet of the compressor and the heat recovery heat exchanger; and the inlet of the compressor and the second heat exchanger; and/or in the fourth switch position, the mode switch valve assembly respectively communicates with the outlet of the compressor and the heat recovery heat exchanger; and the inlet of the compressor and the first heat exchanger;

the mode switch valve assembly comprises a first four-way valve and a second four-way valve, and the first four-way valve has an al port, a b1 port, a c1 port and a d1 port, and the second four-way valve has an a2 port, a b2 port, a c2 port and a d2 port, wherein the a1 port is connected to the outlet of the compressor, the b1 port is connected to the heat recovery heat exchanger, the c1 port is connected to the inlet of the compressor, the d1 port is connected to the a2 port, the b2 port is connected to the first heat exchanger, the c2 port is connected to the inlet of the compressor, and the d2 port is connected to the second heat exchanger;

in the first switch position, the a1 port communicates with the d1 port, the b1 port communicates with the c1 port, the a2 port communicates with the b2 port, and the c2 port communicates with the d2 port; and/or in the second switch position, the a1 port communicates with the d1 port, the b1 port communicates with the c1 port, the a2 port communicates with the d2 port, and the b2 port communicates with the c2 port; and/or in the third switch position, the a1 port communicates with the b1 port, the c1 port communicates with the d1 port, the a2 port communicates with the b2 port, and the c2 port communicates with the d2 port; and/or in the fourth switch position, the a1 port communicates with the b1 port, the c1 port communicates with the d1 port, the a2 port communicates with the d2 port, and the b2 port communicates with the c2 port.

* * * * *